US009554424B2

(12) United States Patent
Schilling et al.

(10) Patent No.: US 9,554,424 B2
(45) Date of Patent: Jan. 24, 2017

(54) METHOD FOR HEATING A COOKING VESSEL WITH AN INDUCTION HEATING DEVICE AND INDUCTION HEATING DEVICE

(71) Applicant: E.G.O. Elektro-Gerätebau GmbH, Oberderdingen (DE)

(72) Inventors: Wilfried Schilling, Kraichtal (DE); Christian Egenter, Bretten (DE); Werner Kappes, Neckargerach (DE); Stefan Westrich, Bretten (DE)

(73) Assignee: E.G.O. ELEKTRO-GERÄTEBAU GMBH, Oberderdingen (DE)

( * ) Notice: Subject to any disclaimer, the term of this patent is extended or adjusted under 35 U.S.C. 154(b) by 859 days.

(21) Appl. No.: 13/627,807

(22) Filed: Sep. 26, 2012

(65) Prior Publication Data

US 2013/0087553 A1 Apr. 11, 2013

(30) Foreign Application Priority Data

Sep. 26, 2011 (DE) ..... 10 2011 083 386

(51) Int. Cl.
*H05B 6/04* (2006.01)
*H05B 6/08* (2006.01)
(Continued)

(52) U.S. Cl.
CPC ..... *H05B 6/062* (2013.01); *H05B 2213/07* (2013.01)

(58) Field of Classification Search
USPC ..... 219/620, 621, 626, 627, 660, 661, 663,219/664, 666, 667
See application file for complete search history.

(56) References Cited

U.S. PATENT DOCUMENTS 3,898,410 A * 8/1975 Peters, Jr. ..... 219/626
4,638,418 A * 1/1987 Alexander ..... H02M 7/517 219/663
(Continued)

FOREIGN PATENT DOCUMENTS

DE 102 53 198 6/2004
DE 102004033115 A1 * 2/2006 ..... F24C 15/106
(Continued)

OTHER PUBLICATIONS

European Search Report dated Jun. 17, 2013 in German patent application 12185400.4 (corresponds to U.S. Appl. No. 13/627,799).
(Continued)

*Primary Examiner* — Hung D Nguyen
(74) *Attorney, Agent, or Firm* — Lee & Hayes, PLLC

(57) ABSTRACT

A method for heating a cooking vessel utilizing an induction heating device is provided. According to various aspects, the induction heating device includes a resonant circuit with an induction heating coil. A specified amount of energy may be supplied to the cooking vessel with the induction heating device depending on a heating power level selected by a user and/or on a cooking vessel type selected by the user. A parameter value of the resonant circuit which is dependent on a temperature of the cooking vessel, in particular of the bottom of the cooking vessel, may be determined and stored. The parameter value may be regulated to a setpoint which is dependent on the stored parameter value.

8 Claims, 2 Drawing Sheets

(51) Int. Cl.
*H05B 6/12* (2006.01)
*H05B 6/06* (2006.01)

(56) References Cited

U.S. PATENT DOCUMENTS

| | | | | |
|---|---|---|---|---|
| 5,488,214 | A * | 1/1996 | Fettig | H05B 6/062 219/667 |
| 6,904,378 | B2 | 6/2005 | Schilling et al. | |
| 6,995,343 | B2 | 2/2006 | Steiner et al. | |
| 2002/0117497 | A1 * | 8/2002 | Bassill | H05B 6/062 219/626 |
| 2005/0121438 | A1 * | 6/2005 | Hirota et al. | 219/663 |
| 2009/0173731 | A1 | 7/2009 | Nagamitsu et al. | |
| 2011/0089156 | A1 | 4/2011 | Santacatterina et al. | |
| 2011/0120989 | A1 | 5/2011 | Schilling et al. | |

FOREIGN PATENT DOCUMENTS

| | | |
|---|---|---|
| DE | 10 2004 033 115 A1 | 9/2006 |
| JP | 2009-105079 | 5/2009 |
| WO | WO2007124008 | 11/2007 |
| WO | WO2010080738 | 7/2010 |

OTHER PUBLICATIONS

European Search Report dated Jun. 14, 2013 in German patent application 12185392.3 (corresponds to U.S. Appl. No. 13/627,807).
European Search Report dated Jun. 14, 2013 in German patent application 12185387.3 (corresponds to U.S. Appl. No. 13/627,803).
U.S. Appl. No. 13/627,799, filed Sep. 26, 2012, entitled "Method for Induction Heating and Induction Heating Device", First named inventor: Schilling.
U.S. Appl. No. 13/627,803, filed Sep. 26, 2012, entitled "Method for Heating a Liquid in a Cooking Vessel and Induction Heating Device", First named inventor: Schilling.
German patent application No. DE 10 2011 083 383.8 filed Sep. 26, 2011.
German patent application No. DE 10 2011 083 397.8 filed Sep. 26, 2011.
German Office Action dated May 24, 2012 in DE 10 2011 083 386.2.
German Office Action dated May 29, 2012 in DE 10 2011 083 397.8.
German Office Action dated May 29, 2012 in DE 10 2011 083 383.8.

* cited by examiner

METHOD FOR HEATING A COOKING VESSEL WITH AN INDUCTION HEATING DEVICE AND INDUCTION HEATING DEVICE

CROSS REFERENCE TO RELATED APPLICATIONS

This application claims the benefit of German patent application DE 10 2011 083 386.2, filed on Sep. 26, 2011, the contents of which are incorporated by reference for all that it teaches.

FIELD

The invention relates to a method for heating a cooking vessel utilizing an induction heating device, and to an induction heating device.

BACKGROUND

With induction heating devices, a magnetic alternating field, which induces eddy currents in a cooking vessel which is to be heated and which has a bottom made of ferromagnetic material, is produced by means of an induction heating coil and causes losses due to reversal of magnetisation, as a result of which the cooking vessel is heated.

The induction heating coil is part of a resonant circuit which comprises the induction heating coil and one or more capacitors. The induction heating coil is normally designed as a flat, helically wound coil with associated ferrite cores and is arranged, for example, under a glass ceramic surface of an induction hob. In doing so, the induction heating coil in conjunction with the cookware to be heated forms an inductive and a resistive part of the resonant circuit.

To drive or excite the resonant circuit, a low-frequency mains alternating voltage with a mains frequency of 50 Hz or 60 Hz for example is first rectified and then converted by means of semiconductor switches into an excitation or drive signal of higher frequency. The excitation signal or drive voltage is usually a rectangular voltage with a frequency in a range from 20 kHz to 50 kHz. A circuit to generate the excitation signal is also referred to as a (frequency) converter.

Different methods have been disclosed for adjusting a heating power supply to the cooking vessel depending on a set heating power setpoint.

In a first method, a frequency of the excitation signal or of the rectangular voltage is varied depending on the heating power to be emitted or supplied or on the required power transfer. This method for adjusting the heating power emission makes use of the fact that a maximum heating power emission occurs when the resonant circuit is excited at its resonant frequency. The greater the difference between the frequency of the excitation signal and the resonant frequency of the resonant circuit, the smaller the heating power emitted.

However, if the induction heating device has a plurality of resonant circuits, for example when the induction heating device forms an induction hob with different induction cooking zones, and different heating powers are set for the resonant circuits, beat frequencies, which can lead to annoying noises, can be caused due to superimposition of the different frequencies of the excitation signals.

A method for adjusting the heating power which prevents annoying noises due to beat frequencies of this kind is a pulse width modulation of the excitation signal at constant excitation frequency, with which an effective value of a heating power is adjusted by varying the pulse width of the excitation signal. However, with an effective-value control of this kind by varying the pulse width at constant excitation frequency, high switch-on and switch-off currents occur in the semiconductor switches, as a result of which a wide-bandwidth and energy-rich interference spectrum is produced.

It is frequently desirable to determine a temperature of the bottom of a cooking vessel which is inductively heated in this way in order, for example, to be able to generate specific time-dependent heating profiles and/or to automatically set an optimum frying temperature at a surface of a pan.

DE 10 2009 047 185 A1, which corresponds to pending U.S. Patent Application No. 2011/0120989, discloses a method and an induction heating device with which temperature-dependent ferromagnetic characteristics of the bottom of the cooking vessel are measured with high resolution and evaluated in order to determine the temperature of the bottom of the cooking vessel.

SUMMARY

The disclosure herein provides a method for heating a cooking vessel utilizing an induction heating device and a corresponding induction heating device. According to various aspects, a specified amount of energy may be supplied to the cooking vessel from the induction heating device according to a heating power level selected by a user or a cooking vessel type selected by the user. A parameter value of the resonant circuit may be determined and stored. The parameter value may include a period duration of a natural-frequency resonant oscillation of the resonant circuit and may be dependent on a temperature of a bottom of the cooking vessel. The parameter value may be regulated to a setpoint which is dependent on the stored parameter value.

BRIEF DESCRIPTION OF THE DRAWINGS

The disclosure is described below with reference to the drawings, which show preferred embodiments. In the drawings.

DETAILED DESCRIPTION

The disclosure herein provides a method to heat a cooking vessel, in particular in the form of a (frying) pan, by means of an induction heating device, wherein the induction heating device comprises a resonant circuit with an induction heating coil. According to various embodiments described in detail below, the method may include supplying of a specified amount of energy to the cooking vessel by means of the induction heating device depending on a heating power level selected by a user and/or on a cooking vessel type selected by the user, subsequent determining and storing of a resulting parameter value of the resonant circuit, in particular of a natural resonant frequency of the resonant circuit or of a period duration associated with the natural resonant frequency, which is dependent on a temperature of the cooking vessel, in particular of the bottom of the cooking vessel, and closed-loop regulation or closed-loop control of the at least one parameter value to a setpoint which is dependent on the stored parameter value.

In an embodiment, the setpoint of the parameter value may be equal to the stored parameter value. In an embodiment, a signal may be output to a user after the specified amount of energy has been supplied to the cooking vessel. Further, in an embodiment, a specified heating power may be applied to the cooking vessel for a specified settling time after the specified amount of energy has been supplied to the cooking vessel and before the parameter value of the resonant circuit is determined and stored. Preferably, the settling time may be chosen to be between one second and 10 seconds, preferably equal to 5 seconds, and the specified heating power may be chosen to be between 10% and 50%, preferably equal to 25%, of a rated heating power.

Figure 1:
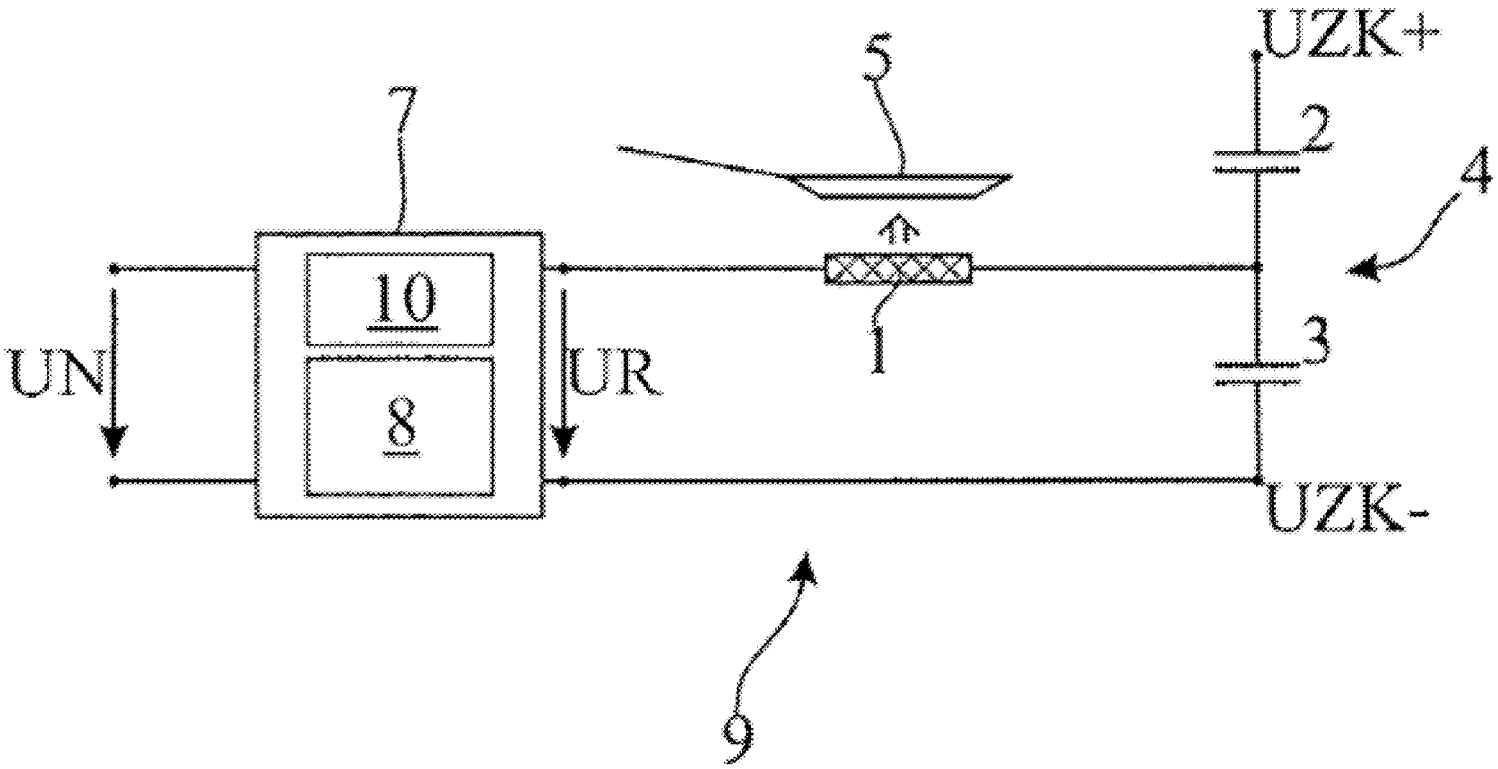
FIG. 1 shows schematically an induction heating device with a resonant circuit which has an induction heating coil, a device for measuring a supplied energy and a control device.

Turning now to the drawings, FIG. 1 shows schematically an induction heating device 9 with a resonant circuit 4 which has an induction heating coil 1 and capacitors 2 and 3, a power stage 7, which, controlled by a control device 8, conventionally rectifies a low-frequency mains alternating voltage UN with a mains frequency of, for example, 50 Hz, and subsequently, by means of semiconductor switches (not shown), converts it to a rectangular voltage UR with a frequency in a range from 20 kHz to 50 kHz, wherein the rectangular voltage UR is applied to the resonant circuit 4 or its induction heating coil 1 in order to supply heating power to a ferromagnetic bottom of a cooking vessel 5, and a device 10 for measuring the energy supply to the cooking vessel 5.

The capacitors 2 and 3 are conventionally looped in series between poles UZK+ and UZK− of an intermediate circuit voltage, wherein a connecting node of the capacitors 2 and 3 is connected to a terminal of the induction heating coil 1.

The induction heating device 9 has measuring means which are not shown in more detail and which enable a continuous or periodic determination of a parameter value of the resonant circuit 4 in the form of a period duration Tp (see FIG. 2) of a natural-frequency resonant oscillation of the resonant circuit 4, wherein the period duration Tp is dependent on the temperature of the bottom of the cooking vessel, i.e. also increases with increasing temperature, as the effective inductance increases with increasing temperature of the bottom of the cooking vessel so that the resonant frequency decreases and accordingly the period duration increases. The period duration Tp can be determined for example by means of a timer of a microcontroller.

With regard to the design and basic function of the measuring means, the measuring method and the heating power adjustment, in order to avoid repetition, reference is also made to DE 10 2009 047 185 A1, which by such reference is herewith made content of the description.

Figure 2:
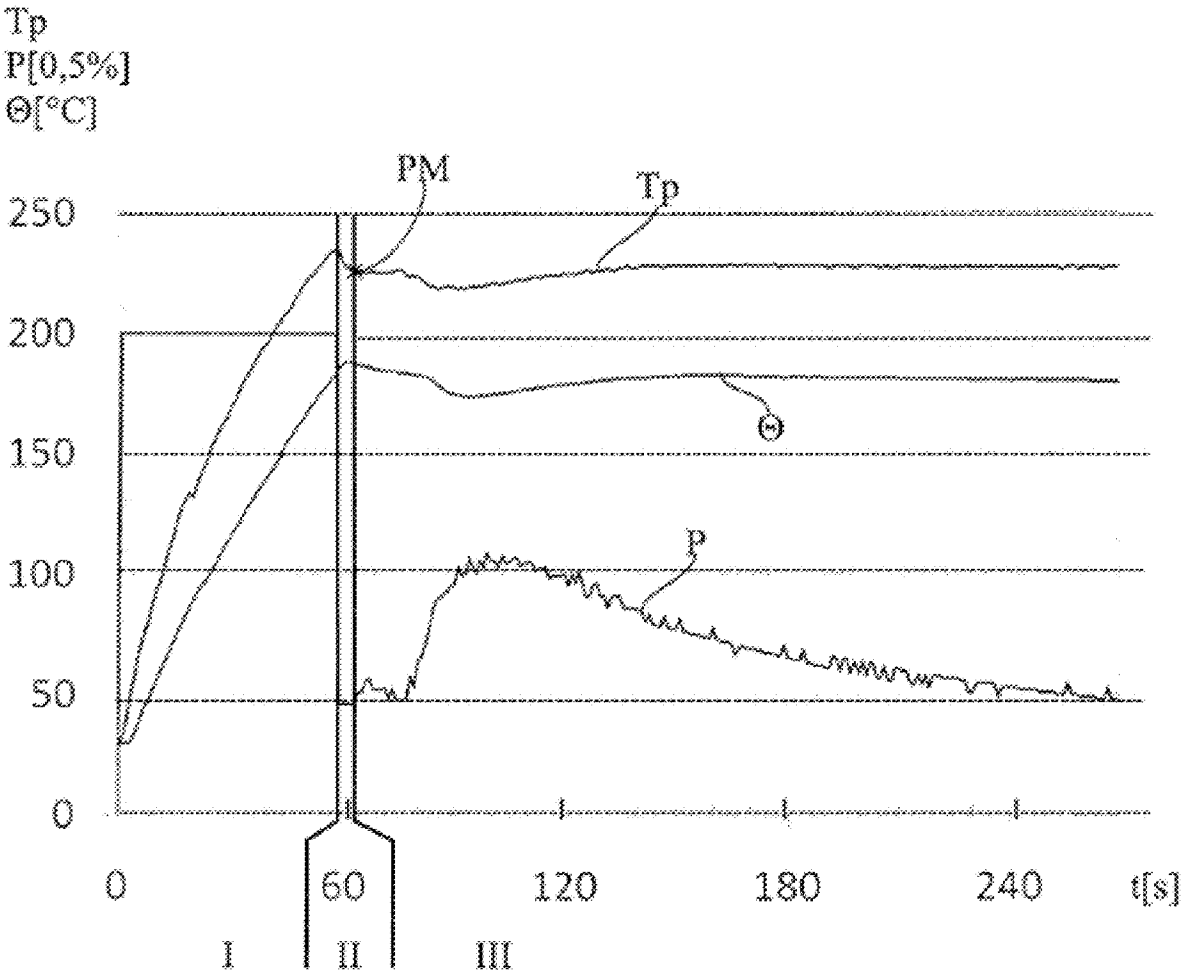
FIG. 2 shows schematically characteristics with respect to time of a temperature of the bottom of a cooking vessel which is heated by means of the induction heating device shown in FIG. 1, a heating power supplied to the cooking vessel by means of the induction heating device, and a period duration of a natural-frequency resonant oscillation of the resonant circuit.

FIG. 2 shows characteristics with respect to time of a temperature Θ of the bottom 5 of the saucepan which is heated by means of the induction heating device 9 shown in FIG. 1, of a heating power P (in 0.5% of a rated heating power) supplied to the cooking vessel 5 by means of the induction heating device, and of the period duration Tp of a natural-frequency resonant oscillation of the resonant circuit 4 when carrying out the method according to the invention.

The control device 8 continuously or periodically determines the period duration Tp of a natural-frequency resonant oscillation of the resonant circuit 4, wherein the heating power supply is briefly interrupted and switched over to a natural-frequency resonant operation of the resonant circuit 4 for this purpose. These phases are not shown in FIG. 2 due to the low time resolution.

In a time interval I, the high-frequency rectangular voltage UR is applied to the resonant circuit 4 with a maximum heating power setpoint (corresponding to 100% of a rated heating power) until, determined by the device 10, a specified amount of energy has been supplied to the cooking vessel 5 by means of the induction heating device 9, wherein the specified amount of energy can be dependent on a heating power level selected by a user and/or on a cooking vessel type selected by the user.

The end of the time interval I is followed by a settling interval II, during which approx. 25% of the rated heating power is applied to the cooking vessel 5 for 5 seconds.

At the end of the time interval II, the instantaneous period duration Tp is determined and stored as setpoint PM. In a subsequent time interval III, the period duration Tp is controlled to the stored setpoint PM.

According to the disclosure, cooking vessels, for example frying pans, are heated to a suitable working temperature by controlling the energy. The amount of energy given by the mass of the cookware, thermal capacity, final temperature and heat loss can be determined, for example experimentally, stored and supplied repeatedly in order to reproduce the required working temperature.

For metering the energy supply, the cooking system has the device 10 for measuring the supplied energy for each cooking zone. The cooking system provides a range of preferably 9 graded amounts of heating energy, which are graded in such a way that both light and heavy frying pans can be heated to a working temperature between 140° C. and 210° C.

For this purpose, for example in a frying mode at heating step 1, an amount of energy which heats a light pan to approx. 140° C., e.g. 25 Wh, is released. At heating step 9, an amount of energy of e.g. 80 Wh, which is able to heat a heavy pan to approx. 200° C., is released. Amounts of energy which lie between the two limits of Steps 1 and 9 are assigned to Steps 2-8.

A user normally only uses a few different types of pan and can therefore quickly learn which step is most suitable for which pan.

Immediately after introducing the heating energy or after a suitably chosen settling time, the current temperature value, or a magnitude representative thereof, is measured inductively and used as a reference value for an (indirect) temperature regulation. It is therefore not necessary to know the exact relationship between measured variable and temperature. In practice, a kind of calibration is carried out every time heating takes place.

If an input device with user communication is available, a choice of different pans can be offered to the user, wherein the user chooses that pan which is most similar to his own or is identical to his own, and also enters the desired temperature. From this, the system is able to derive the required heating energy.

The user is notified that the required frying temperature has been reached by means of an acoustic and/or visual signal.

An addition of food to the cooking vessel 5 can be quickly detected due to a change in the period duration Tp and corrected by increasing the heating power, as can be seen, for example, from FIG. 2 at the beginning of the time interval III. Here, the addition of a steak leads to a reduction in the temperature Θ and the period duration Tp which is corrected accordingly.

In the course of the frying process, the required heating power reduces, and the temperature regulator reduces the supplied power accordingly and therefore protects against a dangerous increase in temperature in the cooking vessel 5.

It is understood that other/additional parameter values can also be used instead of the parameter value of the resonant circuit in the form of the period duration, for example an amplitude of a resonant circuit voltage, a voltage across the induction heating coil, an amplitude of a resonant circuit current and/or a phase shift between the resonant circuit voltage and the resonant circuit current.

It is further understood that the disclosure can also be used in the context of a parallel resonant circuit or a series resonant circuit with full bridge control.

The invention claimed is:

1. A method for heating a cooking vessel utilizing an induction heating device, the method comprising:

supplying a specified amount of energy to the cooking vessel from the induction heating device based on measuring one of a current profile through the induction heating device or a voltage profile across the induction heating device, the induction heating device comprising a resonant circuit and an induction heating coil, wherein the specified amount of energy depends on at least one of a heating power level selected by a user or a cooking vessel type selected by the user;

applying a specified heating power to the cooking vessel for a specified settling time after the supplying the specified amount of energy to the cooking vessel, wherein the settling time is chosen to be between one second and 10 seconds, and the specified heating power is chosen to be between 10% and 50% of a rated heating power;

after the specified settling time, determining and storing a parameter value of the resonant circuit, wherein the parameter value comprises a period duration of a natural-frequency resonant oscillation of the resonant circuit and wherein the parameter value being dependent on a temperature of a bottom of the cooking vessel; and regulating the parameter value to a setpoint which is dependent on the stored parameter value.

2. The method of claim 1, wherein the setpoint of the parameter value is equal to the stored parameter value.

3. The method of claim 1, further comprising outputting a signal to the user after supplying the specified amount of energy to the cooking vessel.

4. The method of claim 1, wherein the determining and storing the parameter value of the resonant circuit occurs after applying the specified heating power to the cooking vessel.

5. An induction heating device, comprising:

a resonant circuit comprising an induction heating coil;

a device configured to measure a specified amount of energy supplied to a cooking vessel by measuring one of a current profile through the induction heating coil or a voltage profile across the induction heating coil; and a control device configured to provide the measured specified amount of energy to the cooking vessel depending on at least one of a heating power level selected by a user or a cooking vessel type selected by the user, apply a specified heating power to the cooking vessel for a specified settling time after the supplying the specified amount of energy to the cooking vessel, wherein the settling time is chosen to be between one second and 10 seconds, and the specified heating power is chosen to be between 10% and 50% of a rated heating power;

after the specified settling time, determine and store a parameter value of the resonant circuit, wherein the parameter value comprises a period duration of a natural-frequency resonant oscillation of the resonant circuit and wherein the parameter value being dependent on a temperature of a bottom of the cooking vessel, and regulate the parameter value to a setpoint which is dependent on the stored parameter value.

6. The induction heating device of claim 5, wherein the control device is further configured to determine and store the parameter value of the resonant circuit after applying the specified heating power to the cooking vessel.

7. A method for heating a cooking vessel utilizing an induction heating device, the method comprising:

supplying a specified amount of energy to the cooking vessel from the induction heating device based on measuring energy supplied to the cooking vessel, the induction heating device comprising a resonant circuit and an induction heating coil, wherein the specified amount of energy depends on at least one of a heating power level selected by a user or a cooking vessel type selected by the user;

applying a specified heating power to the cooking vessel for a specified settling time after the supplying the specified amount of energy to the cooking vessel, wherein the settling time is chosen to be between one second and 10 seconds, and the specified heating power is chosen to be between 10% and 50% of a rated heating power;

determining and storing, after applying the specified heating power to the cooking vessel, a parameter value of the resonant circuit, wherein the parameter value comprises a period duration of a natural-frequency resonant oscillation of the resonant circuit and wherein the parameter value being dependent on a temperature of a bottom of the cooking vessel; and regulating the parameter value to a setpoint which is dependent on the stored parameter value.

8. The method of claim 7, wherein supplying the specified amount of energy to the cooking vessel from the induction heating device being further based on measuring one of a current profile through the induction heating device or a voltage profile across the induction heating device.

* * * * *